US005386286A

United States Patent [19]

Kinouchi et al.

[11] Patent Number: 5,386,286

[45] Date of Patent: Jan. 31, 1995

[54] IMAGE FORMING APPARATUS

[75] Inventors: Satoshi Kinouchi, Tokyo; Takashi Shiraishi, Sagamihara; Koichi Hiruta, Miura; Kazuhisa Kimura, Hiratsuka, all of Japan

[73] Assignee: Kabushiki Kaisha Toshiba, Kawasaki, Japan

[21] Appl. No.: 124,193

[22] Filed: Sep. 21, 1993

[30] Foreign Application Priority Data

Sep. 24, 1992 [JP] Japan ..... 4-280527

[51] Int. Cl.[6] ..... G03G 15/01

[52] U.S. Cl. ..... 355/326 R; 355/327; 346/157

[58] Field of Search ..... 355/327, 326 R, 328; 346/157

[56] References Cited

FOREIGN PATENT DOCUMENTS

| | | | |
|---|---|---|---|
| 0377315 | 7/1990 | European Pat. Off. | 355/326 A |
| 60-60055 | 12/1985 | Japan . | |
| 0004081 | 1/1986 | Japan | 355/326 A |
| 0228461 | 10/1986 | Japan | 355/326 A |
| 0006577 | 1/1988 | Japan | 355/326 A |
| 63-008658 | 1/1988 | Japan . | |
| 0008665 | 1/1988 | Japan | 355/327 A |
| 0049774 | 3/1988 | Japan | 355/327 R |
| 0249161 | 10/1988 | Japan | 355/327 A |
| 0249164 | 10/1988 | Japan | 355/327 A |
| 63-249164 | 10/1988 | Japan . | |
| 0085560 | 4/1991 | Japan | 355/326 A |
| 0288173 | 12/1991 | Japan | 355/326 A |
| 0157478 | 5/1992 | Japan | 355/326 R |
| 2185938 | 8/1987 | United Kingdom | 355/326 A |

*Primary Examiner*—Matthew S. Smith
*Attorney, Agent, or Firm*—Foley & Lardner

[57] ABSTRACT

A color copying machine includes a plurality of image forming sections having rotatable photoconductive drums, respectively. One of the drums, which is used for forming images in black, is rotated by a first drum drive motor, and the other drums are rotated by a second drum drive motor. A plurality of transfer devices are arranged to oppose the image carriers, respectively. A paper sheet is sequentially moved to positions opposing the drums and clamped between the drums and transfer rollers so as to transfer images on the drum to the paper sheet. When a image formation is performed by using the image forming section for black, the first drive motor is operated and the second motor is stopped. The transfer rollers opposing the drums for other than black are moved to positions wherein these transfer rollers are away from the corresponding drums.

9 Claims, 11 Drawing Sheets

IMAGE FORMING APPARATUS

BACKGROUND OF THE INVENTION

1. Field of the Invention

This invention relates to an electrophotographic image forming apparatus such as full color copying machines, color laser printers, and the like, and, more particularly, it relates to an image forming apparatus for forming images on a paper sheet by means of a plurality of photoconductive drums.

2. Description of the Related Art

Recently, digital full color copying machines have been developed and getting popularity on a demand for color images. As one of color copying machines, there is provided a Four-tiered photoconductive drum type full color copying machines which comprise four photoconductive drums. In this type of copying machine, four photoconductive drums are arranged in parallel with one another, and images in yellow, magenta, cyan and black are formed on the drums, respectively. A transfer material is carried by a conveyer belt and sequentially brought into contact with these drums, so that the toner images on the drums are transferred to the drums and overlapped with each other. Thus, a full color image can be obtained.

Upon forming an image other than a full color image by means of the copying machine, e.g., an image in black, toner images are not formed on the three drums for yellow, magenta, and cyan and only a black toner image is formed on the drum for black. Then, the black toner image is transferred to a transfer material, thereby obtaining a black image.

A problem with such a copying machine is that, even when a monochromatic image is formed, the drums and developing devices for the remaining three colors are also driven. In other words, the three drums and the associated developing devices that do not participate in forming a monochromatic image are unnecessarily and uneconomically operated. Thus, the drum surfaces are worn off by cleaning devices which are in contact with the drum surfaces, and the drums and the associated developing devices are fatigued as they contact with each other. Additionally, the developing sleeves of the developing devices may remarkably be worn and the toner may quickly be degraded as the sleeves are in contact with the toner.

In order to solve the above problems, Japanese Patent Application KOKAI Publication No. 63-8658 discloses an image forming apparatus in which only an image carrier and a developing device associated therewith used for image formation are driven and another image carriers and developing devices are stopped. However, this Publication does not concretely show drive means for driving the image carriers and the developing devices.

In Japanese Patent Application KOKAI Publication No. 4-76565 is disclosed an apparatus wherein selecting means for selectively driving a developing device is arranged on a drive shaft of an image carrier and the developing device is moved toward and away from the image carrier by the selecting means. However, in this apparatus, the image carrier is larger than that in the Four-tiered photoconductive drum type copying machine. Further, supporting members for the developing devices are rotated individually, thereby generating large vibrations and influencing formed images.

Japanese Patent Application KOKAI Publication No. 4-134463 discloses a mechanism for switching a transfer sheet clamp mechanism and a transfer roller. However, this mechanism is complex in structure and large in manufacturing cost.

SUMMARY OF THE INVENTION

The present invention is contrived in consideration of the above circumstances, and its object is to provide an image formation apparatus capable of forming full color images and effectively preventing tear and wear of the image carriers and developing devices.

According to the present invention, there is provided an image forming apparatus which comprises means for rotating a plurality of rotatable image carriers; means for forming toner images on the image carriers; a plurality of transfer means arranged to oppose the image carriers, respectively, for transferring the toner images from the image carriers to a transfer material by sequentially opposing the transfer material to each of the image carriers and clamping the transfer material with the image carriers to which the transfer material is opposed; means provided in contact with each of the image carriers, for scraping toner from the image carriers by the rotation of the image carriers after the transfer of the toner images; means for, when the image forming means performs an image formation by using one or some of the image carriers, transmitting the rotating force of the rotating means to only said one or some of the image carriers used for the image formation; and means for relatively moving the image carriers, which are transmitted with no drive force by the transmitting means, and the corresponding transfer means so that said transfer means are away from positions wherein the transfer means clamp the transfer material.

With the image formation apparatus having a configuration as described above, when an image formation is performed by using all the image carriers, the drive force of the rotating means is transmitted to all the image carriers by the transmitting means. When an image formation is performed by using one of the image carriers, the drive force is transmitted only to the image carrier and the transfer means opposing the remaining image carriers are moved away from the corresponding image carriers by the moving means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 through 5 illustrate a color copying machine according to a first embodiment of the present invention, in which:

FIG. 1 is a schematic sectional view of the copying machine,

FIG. 2 is a side view showing a separating mechanism for moving a photoconductive drum away from a conveyer belt, FIG. 3 is a partial front view of the separating mechanism of FIG. 2, FIG. 4 is a schematic perspective view showing a drive mechanism of the copying machine, and FIG. 5 is a block diagram of the drive mechanism;

DETAILED DESCRIPTION OF THE PREFERRED EMBODIMENTS

There will now be described embodiments of the present invention with reference to the accompanying drawings.

Figure 1:
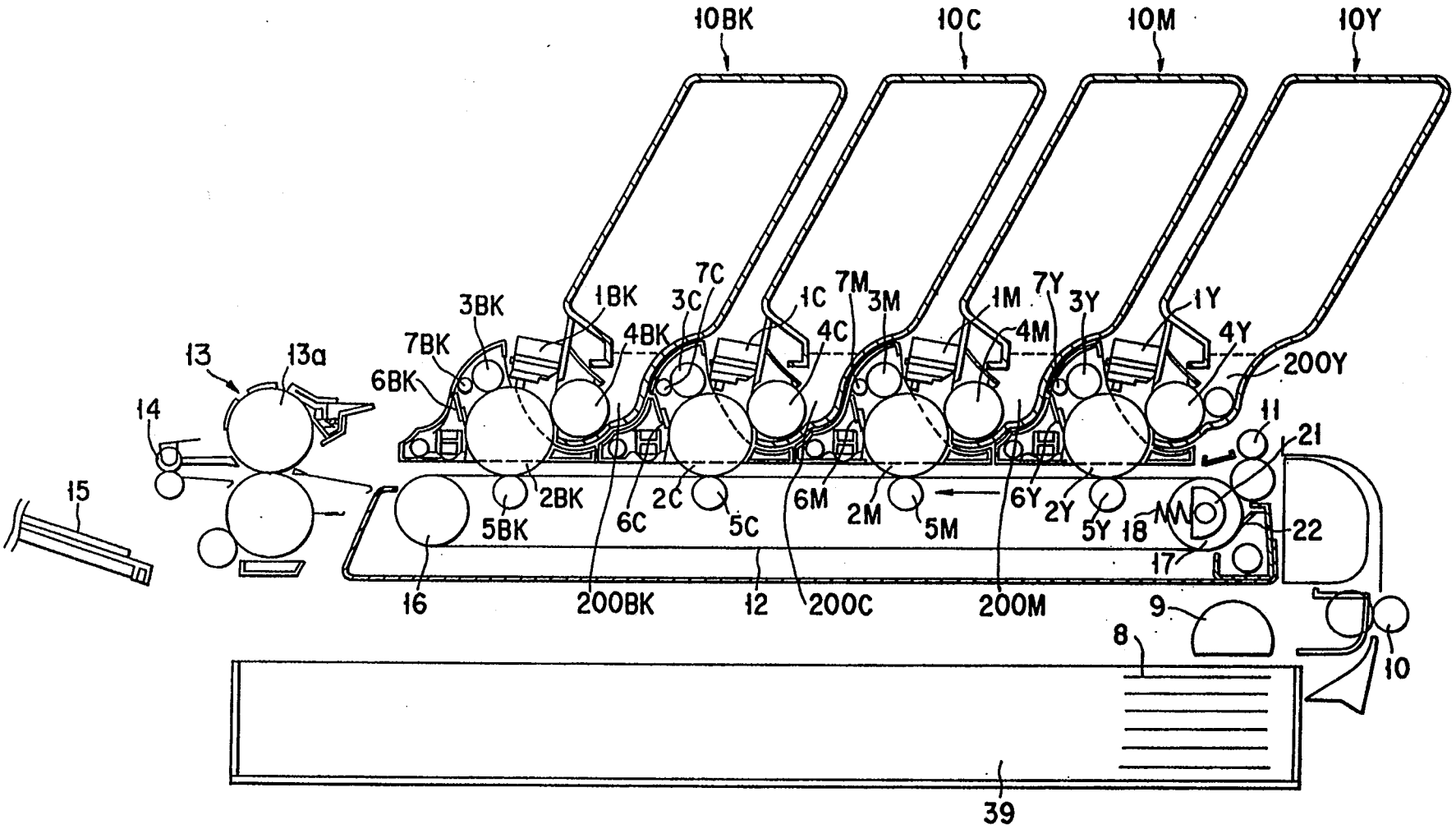

FIG. 1 schematically shows a four-serise photoconductive drum type full color copying machine according to an embodiment of the invention. The copying machine comprises four image forming sections 10Y, 10M, 10C and 10BK for electrophotographically forming four visible images in yellow, magenta, cyan and black respectively. The image forming sections are arranged in a row in a feeding direction of transfer materials described latter.

Since all the image forming sections have an identical configuration, only the image forming section 10Y for forming images in yellow will be described here and the description for the remaining sections will be omitted.

The image forming section 10Y is provided with a photoconductive drum 2Y serving as an image carrier, around which are sequentially arranged a charger 3Y for charging the surface of the photoconductive drum 2Y, a solid scanning head 1Y, a developing device 200Y, a transfer device 5Y, a cleaning device 6Y, and a discharger 7Y in the above order. The cleaning device 6Y includes a cleaning blade which contacts the outer circumferential surface of the drum 2Y so as to scrape toner remaining on the drum by the rotation of the drum.

The photoconductive drum 2Y is rotated at an outer peripheral speed of V0 by a drum drive motor 56 described latter. The outer surface of the photoconductive drum 2Y is electrically charged by the charger 3Y comprising a conductive charging roller which is in contact with the outer surface of the drum 2y. The charging roller is rotated as long as it is in contact with the surface of the photoconductive drum 2Y.

The surface of the drum 2Y is formed of an organic photoconductor having a characteristic wherein its resistance is normally high but an area radiated with light changes in its relative resistance. Thus, in accordance with an image data for yellow output from a control section (not shown), the solid scanning head 1Y radiates exposure light toward the charged surface of the drum 2Y through an optical system with equivalent magnification (not shown), thereby forming an electrostatic latent image for yellow print pattern on the surface of the drum 2Y.

An electrostatic latent image is an image formed on the surface of a photoconductive drum 2Y by electrification. More specifically, it is a negative image formed on the surface of the photoconductive drum 2Y, as given areas of the drum surface formed of a photoconductor are irradiated with light emitted from the solid scanning head 1Y and reduced in their relative resistance, so that the electric charges in the areas may flow away while the electric charges on the areas of the surface that are not irradiated with light emitted from the head 1Y remain there without flowing away.

The solid scanning head 1Y comprises a number of minute light emitting elements arranged in a main scanning direction with equal intervals. It so controls the light emitting elements to cause them to selectively emit light in accordance with on/off control signals transmitted from the printing control section. Light emitted from activated light emitting elements are converged on the surface of the drum 2Y by way of the optical system with equivalent magnification so that the drum surface is exposed by the light. In this embodiment, an LED head array having a resolution of 300DPI and a SELFOC lens array are respectively used the solid scanning head 1Y and the optical system.

The photoconductive drum 2Y on which an electrostatic latent image is formed is rotated to a developing section at the peripheral speed V0. In the developing section, the latent image on the drum 2Y is developed by the developing device 200Y to form a visible toner image.

The developing device 200Y is driven by a developing device drive motor 78 described later, and stores therein a quantity of yellow toner made of resin containing yellow pigment. The yellow toner is stirred within the developing device 200Y and triboelectricaly charged to have a polarity same as that of the electric charge on the surface of the photoconductive drum 2Y. Then, as the surface of the drum 2Y passes through a developing sleeve 4Y of the developing device 200Y, the yellow toner electrostatically adheres to the latent image on the drum surface, thereby developing the latent image (Reversal development).

The photoconductive drum 2Y carrying the developed yellow toner image is continuously rotated at the peripheral speed v0 and the yellow toner image is then transferred by the transfer device 5Y onto a paper sheet 8 (transfer material) which is fed from a paper feeding system at a predetermined timing. Then, the drum 2Y is further rotated at the peripheral speed v0 so that toner and dust particles remaining on the drum surface are removed by the cleaning device 6Y. Then, the drum surface is deelectrified by the discharger 7Y to have a given electric potential. Thereafter, above-mentioned processes are repeated if necessary.

The paper feeding system comprises a pickup roller 9, a feed roller 10 and a resist roller 11. A paper sheet 8 is taken out of a paper feeding cassette 39 and fed to the resist roller 11 by the feed roller 10. The resist roller rectifies the posture of the paper sheet 8 and forwards it to a conveyer belt 12. The peripheral speed of the resist roller 11 and the running speed of the conveyer belt 12 are so adjusted to match the peripheral speed v0 Of the photoconductive drum 2Y. Thus, the paper sheet 8 is fed to the transfer section on the drum 2Y by the conveyor belt, while part of the sheet is held by the resist roller 11.

At the transfer section, the yellow toner image on the drum surface is in contact with the paper sheet 8 and transferred thereto by the image transfer device 5Y. Thus, the yellow toner image with a print pattern based on the yellow print signals is formed on the paper sheet 8.

The transfer device 5Y comprises a semiconductive transfer roller. The transfer roller is kept in rolling contact with the photoconductive drum 2Y through the conveyer belt 12 and applies the paper sheet 8 from the underside of the conveyer belt with an electric field having a polarity opposite to that of the electric potential of the yellow toner electrostatically adhering to the photoconductive drum 2Y. The electric field affects the yellow toner image on the drum 2Y through the conveyer belt 12 and the paper sheet 8, thereby causing the toner image to be transferred from the drum 2Y to the paper sheet 8.

The paper sheet 8 now carrying the yellow toner image is then sequentially fed to the magenta image forming section 10M, the cyan image forming section 10C and the black image forming section 10BK by the conveyer belt 12.

Note that each of the magenta image forming section 10M, the cyan image forming section 10C and the black image forming section 10BK has a configuration same as that of the above described yellow image forming section 10Y. Thus, the same parts in the sections 10M, 10C and 10BK as those in the section 10Y are indicated the same reference numerals together with reference symbols M for 10 magenta, C for cyan and BK for black respectively in place of Y for yellow, and detailed description thereof will be omitted.

When the paper sheet 8 is sequentially passed by the yellow, magenta, cyan and black transfer sections and a full color image is formed on it, the paper sheet is fed into a fixing device 13. The fixing device 13 comprises a heat roller **13*a* provided with a heater therein. The toner image carried on the paper sheet 8 and held there only by attraction of electric charge is heated to melt by the fixing device 13 until it is permanently fixed on the sheet of paper 8. Thereafter, the paper sheet 8 carrying the fixed full color image is sent to a sheet delivery tray 15 by way of a discharge roller 14**.

The photoconductive drums 2Y, 2M, 2C and 2BK are arranged in a row and in parallel with one another. The conveyer belt 12 for conveying paper sheets 8 is an endless belt running around a drive roller 16 and a driven roller 17 disposed on the fixing device 13 side and the paper feeding side, respectively. The drive roller 16 is rotated by a drive motor (not shown) at a rate that makes the peripheral speed v0 of the photoconductive drums equal to the running speed of the conveyer belt 12.

Figure 2:
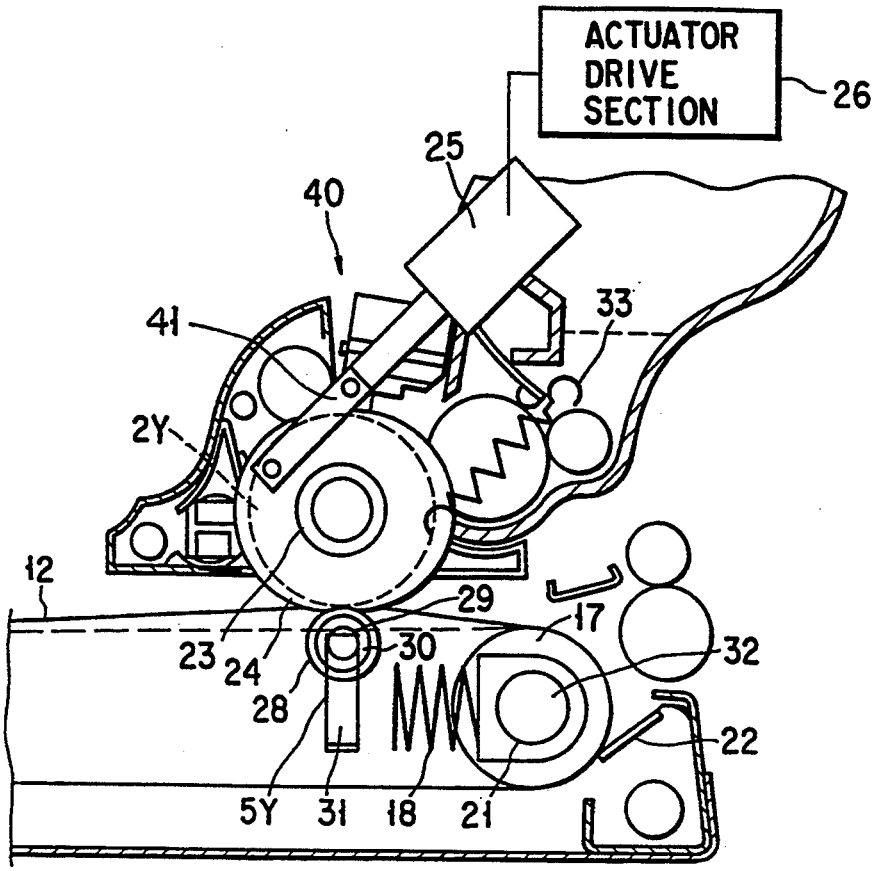

As seen from FIGS. 1 and 2, the driven roller 17 is supported by a support mechanism to be movable toward and away from the drive roller 16. More specifically, each end of a shaft 32 of the driven roller 17 is slidably inserted into an elongated hole formed in a support frame (not shown) and supported by a roller support member 21. The roller support member 21 is urged in the direction away from the drive roller 16 by a compression spring 18. Thus, the conveyer belt 12 is constantly subjected to a desired level of tension generated by the driven roller 17. After sending out the paper sheet 8 to the fixing device 13, the conveyer belt 12 is cleaned by a belt cleaning device 22 to get rid of toner and dust of paper remaining on the belt surface to become ready to receive another paper sheet 8 for next copying operation.

Figure 3:
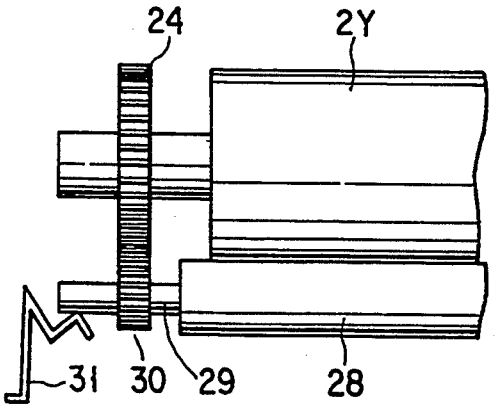

As illustrated in FIGS. 2 and 3, the copying machine is provided with a separating mechanism 40 for separating the drums 2Y, 2M and 2C from the conveyer belt 12 when an image formation is performed by using only one color or black. The separating mechanism 40 comprises a pair of elliptic cams 24 fitted to the respective opposite ends of the rotary shaft of the photoconductive drum 2Y through bearings 23, respectively. Each of the elliptic cams 24 is connected via a link 41 to an actuator 25, which is driven by an actuator drive section 26. The elliptic cams 24 are held to a neutral position by tension springs 33, respectively.

The transfer device 5Y is provided with a transfer roller 28 having a center shaft 29. A pair of guide rollers 30 are fitted on the opposite ends of the center shaft 29, respectively. The transfer roller 28 is pressed against the photoconductive drum 2Y via the conveyer belt 12 by means of an insulated pusher spring 31. The guide rollers 30 are pressed against the corresponding elliptic cams also by the pusher spring 31, which pusher springs 31 are anchored to the base (not shown) of the transfer device. Note that each of the image forming sections 10M and 10C is also provided with an identical separating mechanism.

With the separating mechanism 40 described above, when the convey belt is brought into contact with each drum so as to perform a full color copying, the elliptic cam 24 is held in the neutral position shown in FIG. 3 by the tension spring 33. Consequently, the conveyer belt 12 is pressed against the photoconductive drums 2Y, 2M, 2C and 2BK by the pusher springs 21 by way of the respective transfer rollers 28. The length of the minor axis of the elliptic cam 24 and the radius of the guide roller 30 are so determined that the transfer rollers 28 are pressed against the conveyer belt 12 and the photoconductive drums 2Y, 2M and 2C under optimum conditions.

Figure 5:
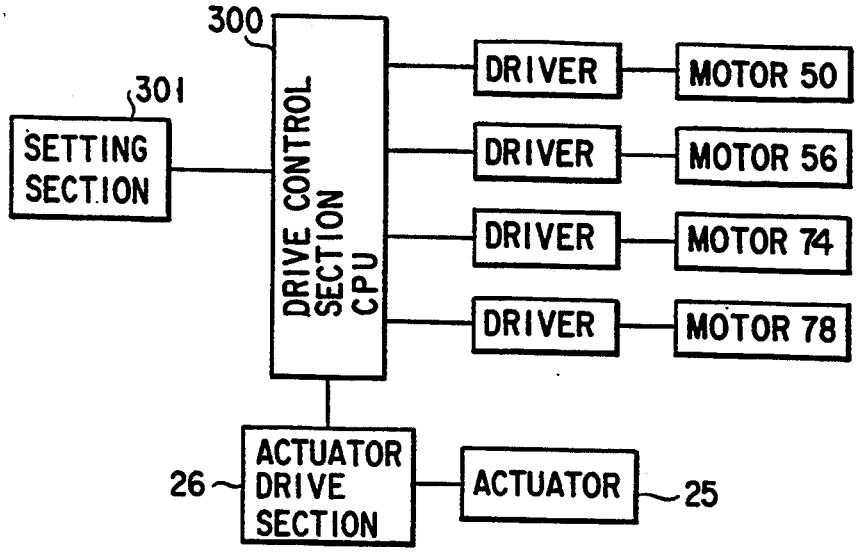

When, on the other hand, the photoconductive drums 2Y, 2M and 2C need to be separated from the conveyer belt 12 for copying operation with single color, the actuator 25 is driven by the actuator drive section 26 in accordance with the signal transmitted from a drive control section 300 (FIG. 5). Then, the cams 24 supported on the drums 2Y, 2M and 2C are rotated clockwise by approximately 45 degrees to a pressing position, where the cam push down the corresponding guide rollers 30 and consequently the conveyor belt 12 is moved away from the drums 2Y, 2M and 2C as indicated by a broken line in FIG. 2.

Figure 4:
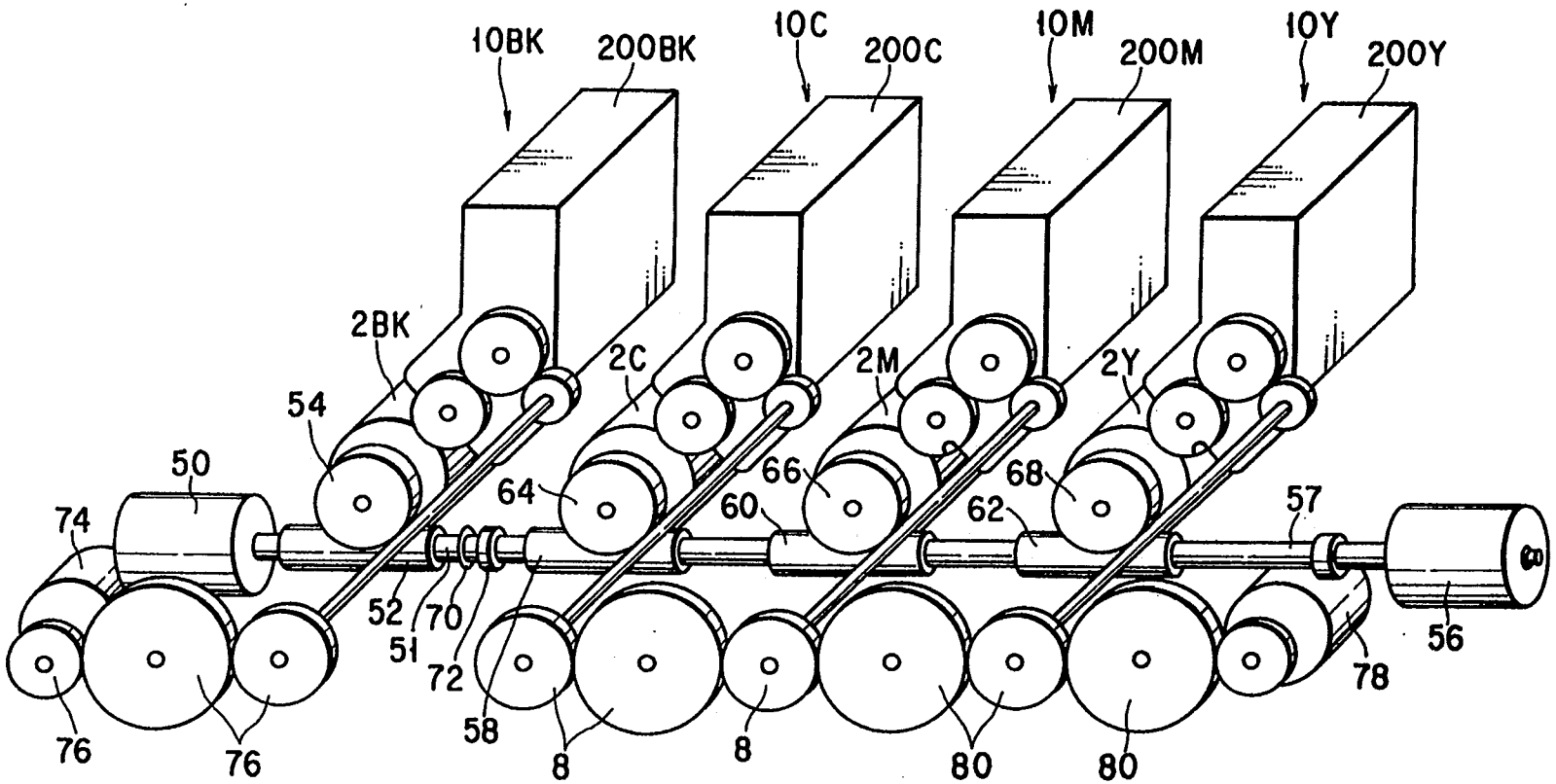

FIG. 4 schematically illustrates a drive mechanism for the image formation sections 10Y, 10M, 10C and 10BK of the first embodiment. The drive mechanism has a pair of drive motors for driving the photoconductive drums and another pair of drive motors for driving the developing devices, which are used alternatively for full color image formation and single color image formation.

More specifically, the drive system for driving the photoconductive drums comprises a first drum drive motor 50 for black copying and a second drum driving motor 56 for color copying. A first drive shaft 51 is coaxially coupled with to the rotational shaft of the first drum drive motor 50. A worm gear 52 is fitted on the first drive shaft 51 and engaged with a helical gear 54 fitted to the rotational shaft of the photoconductive drum 2BK of the image forming section 10BK.

A second drive shaft 57 is coaxially coupled with the rotational shaft of the second drum drive motor 56. The first and second drive shafts 51 and 57 are coaxial with each other. The free ends of the drive shafts are supported by bearings 70 and 72, respectively. Three worm gears 58, 60 and 62 for the image forming sections 10C, 10M and 10Y (for cyan, magenta and yellow) are fitted to the second drive shaft 57 and held in engagement with respective helical gears 64, 66 and 68 which are in turn fitted to the respective rotational shafts of the photoconductive drums 2C, 2M and 2Y.

The drive system for driving the developing devices comprises a first developing device drive motor 74 for black copying operation and a second developing device drive motor 78 for color copying operation. The first developing device drive motor 74 drives the developing device 200BK of the image forming section 10BK through a gear train 76. The second developing device drive motor 78 drives the developing devices 200C, 200M, and 200Y of the image forming sections 10C, 10M and 10Y through another gear train 80.

The above described first and second drum drive motors 50 and 56, the first and second developing device drive motors 74 and 78, and the gear trains 76 and 80 are disposed on and supported by a support frame of the copying machine.

As shown in FIG. 5, each of the motors 50, 56, 74 and 78 is connected to the drive control section (CPU) 300 through a driver. The actuator drive section 26 is also connected to the control section 300. Thus, these motors and the actuator 25 are driven by the control section 300 in accordance with an input signal which is input through a setting section 301.

For color copying, using the color copying machine having the above-mentioned configuration, all the four drive motors 50, 56, 74 and 78 are driven in accordance with a control signal transmitted from the CPU 300, and thus, an image formation and image transfer are performed by using all the image forming sections 10BK, 10C, 10M and 10Y. For black copying, only the first drum drive motor 50 and the first developing device drive motor 74 are driven while the second drum drive motor 56 and the second developing device drive motor 78 are held at rest. Specifically, in black copying operation, only the image forming section 10BK is driven, and the photoconductive drums 2C, 2M and 2Y and the developing devices 4C, 4M and 4Y of the remaining image forming sections are held inoperative.

In the color copying operation, the conveyer belt 12 is held in contact with the photoconductive drums BK, 2C, 2M and 2y, whereas in the black copying operation, the conveyer belt 12 and the transfer rollers 28 are moved away from the photoconductive drum 2C, 2M and 2Y by the respective separating mechanisms 40.

With the color printing machine having the above described configuration, in single color copying operation or black copying operation, only the image forming section 10BK for black is driven by the first drum drive motor 50 and the first developing device drive motor 74, while the image forming sections 10C, 10M and 10Y that are not related to the black copying operation are held inoperative. Thus, the image forming sections 10C, 10M and 10Y can be prevented from being unnecessary driven, thus, unnecessary wear and tear of the surfaces of the photoconductive drums 2C, 2M and 2Y due to the contact with the cleaning devices 6C, 6M and 6Y. Likewise, any unnecessary fatigue of the drums and the developing devices due to contact between related ones of them can be avoided. Further, wear of the developing sleeves of the developing devices 200C, 200M and 200Y due to the contact with the toner and consequent degradation of the toner can be minimized.

Figure 6:
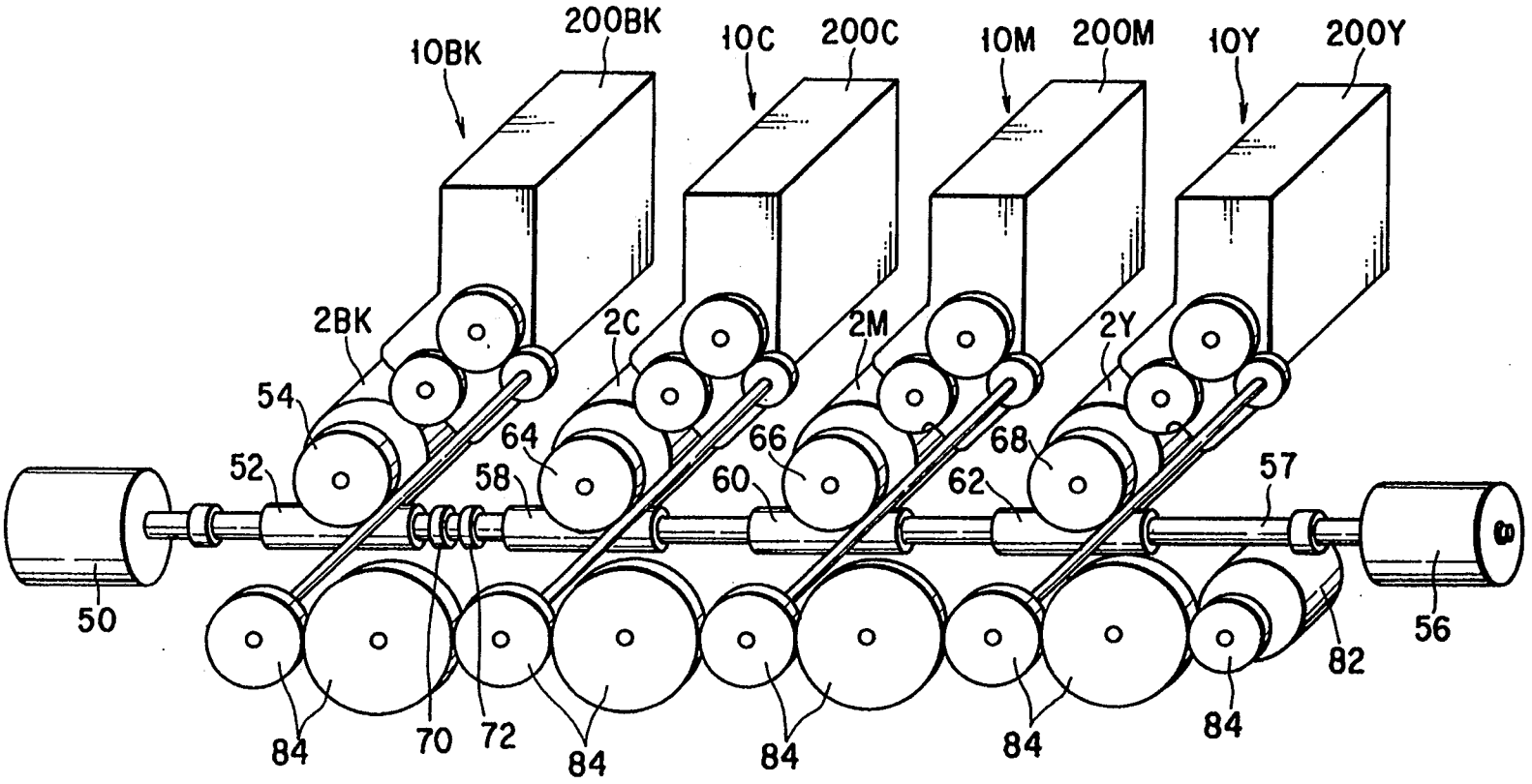
FIG. 6 is a schematic perspective view showing a drive mechanism of a color copying machine according to a second embodiment of the present invention.

FIG. 6 shows a drive mechanism of a color copying machine according to a second embodiment of the invention. Since this embodiment is in most part similar to the above described first embodiment and differs from the latter only in that a single motor is commonly used to drive the developing device for black and those for color images in the image forming sections, only the components that are different from those of the first embodiment will be described and detailed description of the remaining ones will be omitted. In FIG. 6, the components identical with or similar to those in the first embodiment are indicated by the same reference numerals.

Figure 7:
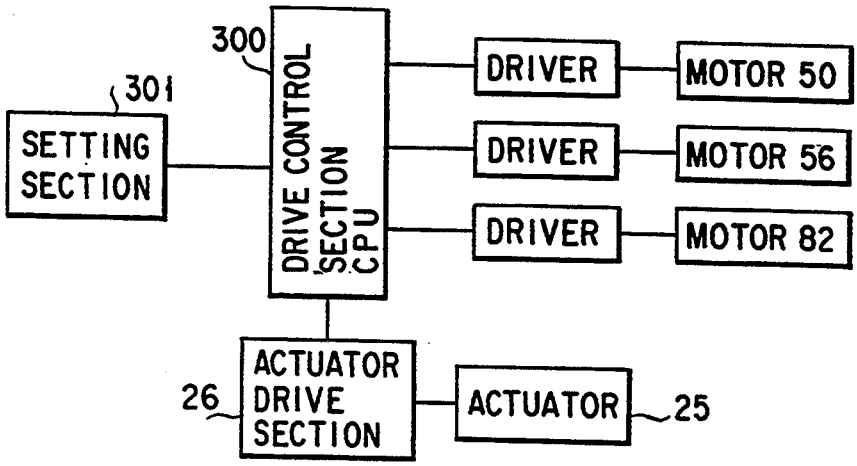
FIG. 7 is a block diagram of the drive mechanism of the second embodiment.

In the second embodiment, the developing devices 200BK, 200C, 200M and 200Y of the image forming sections 10BK, 10C, 10M and 10Y are driven by a single developing device drive motor 82. The drive force of the motor 82 is transmitted to the developing devices 200BK, 200C, 200M and 200Y for the respective colors (black, cyan, magenta and yellow) by way of a gear train 84. As shown in FIG. 7, each of the motors 50, 56 and 82 is connected to the drive control section 300 through a driver.

The developing device drive motor 82 is operated both in full color printing and in black printing so as to drive the four developing devices. Otherwise, the second embodiment operates in a manner similar to that of operation of the first embodiment so that only the photoconductive drum 2BK is driven by the first drum drive motor 50 whereas all the four photoconductive drums 2BK, 2C, 2M and 2Y are simultaneously driven by the first and second drum drive motors 50 and 56.

Thus, also with the second embodiment, in the copying operation for black, the photoconductive drums for other colors are kept in nonoperating condition, thereby preventing unnecessary wear and tear of the drum surfaces due to the contact with the respective cleaning devices 6C, 6M and 6C. Likewise, any unnecessary fatigue of the photoconductive drums and the developing devices due to contact between related ones of them can be avoided.

Figure 8:
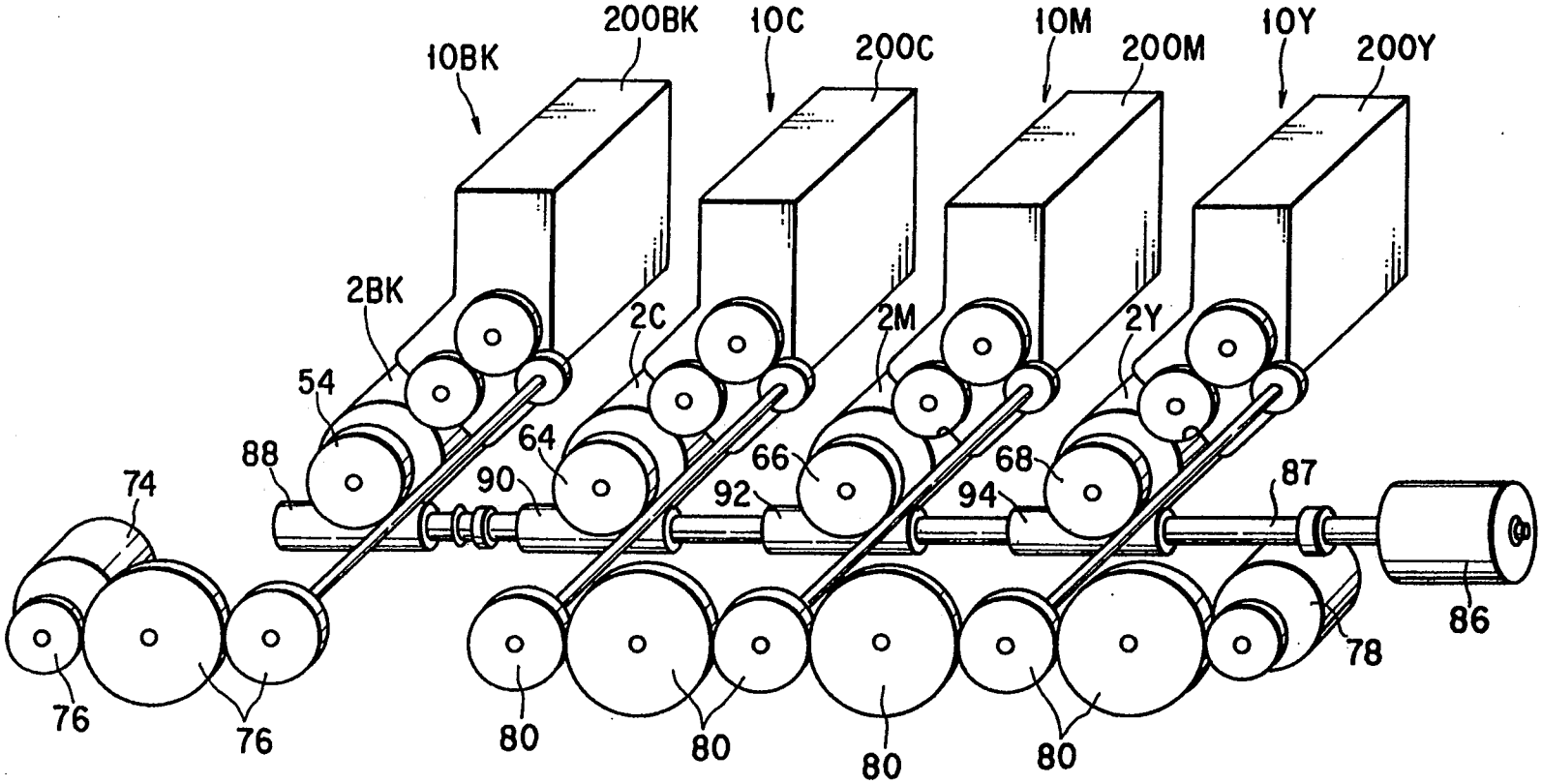
FIG. 8 is a schematic perspective view showing a drive mechanism of a color copying machine according to a third embodiment of the present invention.

FIG. 8 is a schematic perspective view of the drive mechanism of a color copying machine according to a third embodiment of the invention. The arrangement of this embodiment is similar to the above described first embodiment and differs from the latter only in that a single motor is commonly used to drive the photoconductive drums 2BK, 2C, 2M and 2Y and this embodiment is not provided with separating mechanisms 40 for separating the respective photoconductive drums 2C, 2M and 2Y from the conveyer belt 12 in the black copying operation. Only the components that are different from those in the first embodiment will be described and detailed description of the remaining ones will be omitted, the components identical with or similar to those in the first embodiment being indicated by same reference numerals.

Figure 9:
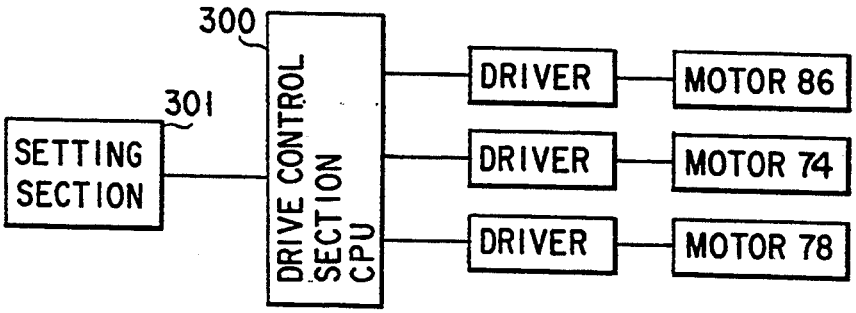
FIG. 9 is a block diagram of the drive mechanism of the third embodiment.

In the drive mechanism of this embodiment for driving the photoconductive drums, the rotary shaft of a single drum drive motor 86 is coaxially connected to a drive shaft 87, to which four worm gears 88, 90, 92 and 94 for the respective image forming sections 10BK, 10C, 10M and 10Y are rigidly fitted. The worm gears 88, 90, 92 and 94 are in engagement with respective helical gears 54, 64, 66 and 68. Thus, the four photoconductive drums 2BK, 2C, 2M and 2Y are driven by the single motor 86 respectively through the helical gears 54, 64, 66 and 68 and the worm gears 88, 90, 94 and 94. As shown in FIG. 9, each of the motors 76, 78 and 86 is connected to the drive control section 300 through a driver.

In the third embodiment having the above described configuration, all the four photoconductive drums 2BK, 2C, 2M and 2Y are driven by a single drum drive motor 86 for both full color copying and for single color or black copying. In black copying operation, only the developing device 200BK is driven by the first developing device drive motor 74, whereas all the four developing devices 200BK, 200C, 200M and 200Y are driven by the first and second developing device drive motors 74 and 76 for color copying operation. Thus, with the third embodiment, in the black copying operation, the developing devices 200C, 200M and 200Y are kept away from use to prevent unnecessary wear and tears of the devices. Likewise, any unnecessary fatigue of the developing sleeves of the developing devices and toner due to contact between them can be avoided.

Figure 10:
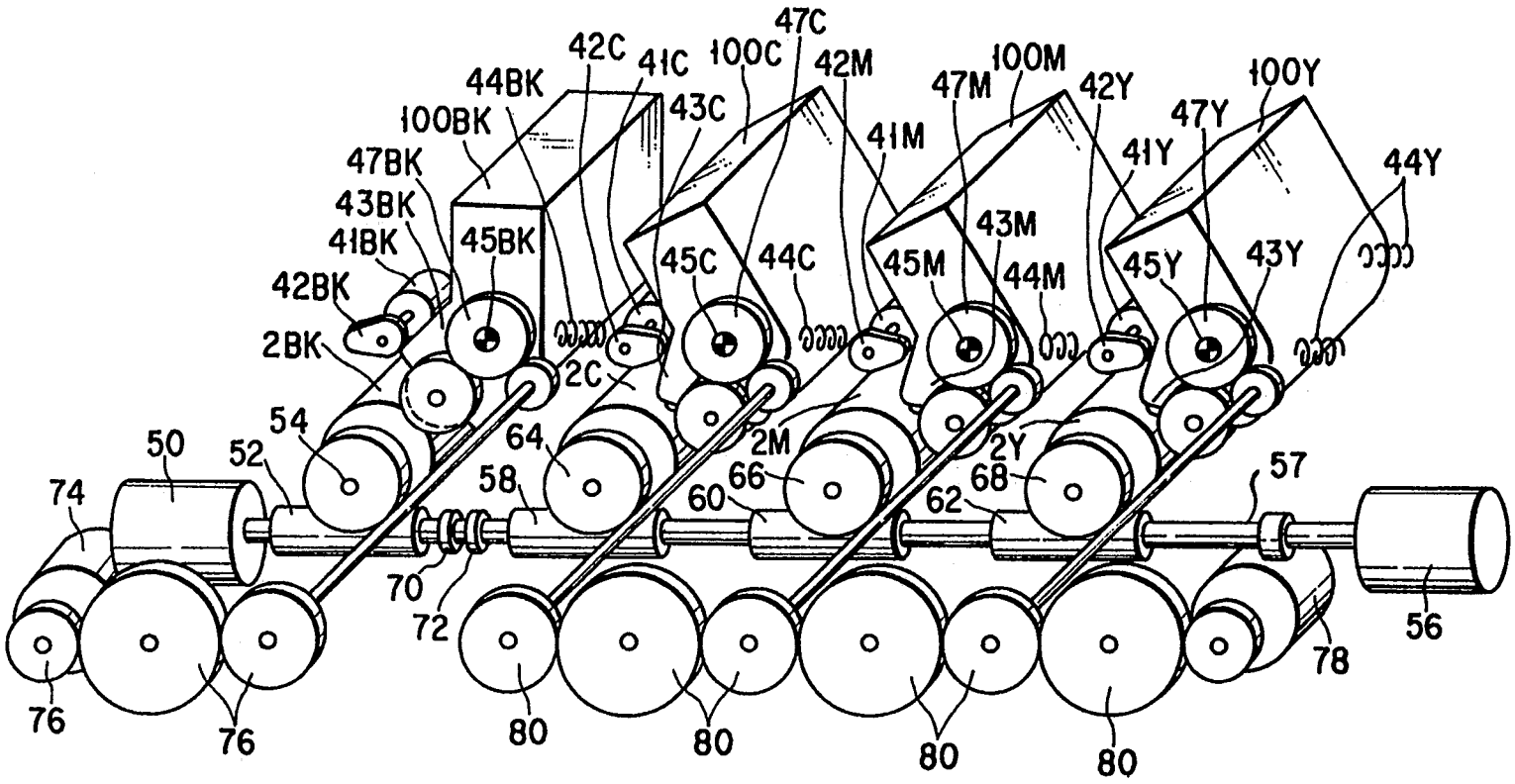
FIG. 10 is a schematic perspective view showing a drive mechanism of a color copying machine according to a fourth embodiment of the present invention.

FIG. 10 shows a drive mechanism of a color copying machine according to a fourth embodiment of the present invention. Since this embodiment is similar to the above described first embodiment but differs therefrom in the construction of each developing device and in that there is provided a separating mechanism for separating the developing device from the associated photoconductive drum. Only the components that are different from those in the first embodiment will be described in detail and the description of the remaining ones will be omitted, the components identical with or similar to those in the first embodiment being indicated by the same reference numerals.

In this embodiment, the developing devices 100BK, 100C, 100M and 100Y are supported on a frame (not shown) to be rotatable around pivots 45BK, 45C, 45M and 45Y, respectively. On the frame is provided rotary solenoids 41BK, 41C, 41M and 41Y near the respective developing devices, as means for separating the developing devices from the respective photoconductive drums. The shafts of the rotary solenoids 41BK, 41C, 41M and 41Y are fitted with cams 42BK, 42C, 42M and 42Y, respectively. The developing devices 100BK, 100C, 100M and 100Y are provided with respective projections 43BK, 43C, 43M and 43Y which are in contact with the cams 42BK, 42C, 42M and 42Y, respectively. Springs 44BK, 44C, 44M and 44Y are attached to the frame and abut against those portions of the developing devices 100BK, 100C, 100M and 100Y which are opposite to the projections 43BK, 43C, 43M and 43Y, respectively. A gear 47BK is fitted to the pivot 45BK of the developing device 100BK so that the developing device 100BK is driven by the first developing device drive motor 50 by way of the gear 47BK and a gear train 76, whereas the pivots 45C, 45M and 45Y of the developing devices 100C, 100M and 100Y are fitted with respective gears 47C, 47M and 47Y so that the developing devices 100C, 100M and 100Y are driven by the second developing device drive motor 56 by way of the respective gears and gear trains 80.

Figure 11:
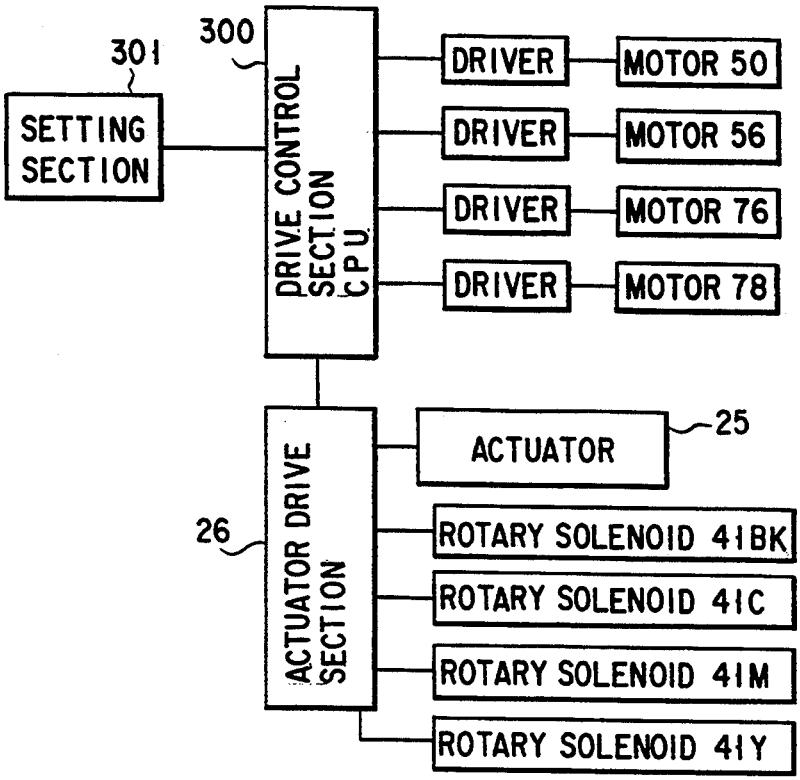
FIG. 11 is a block diagram of the drive mechanism of the fourth embodiment.

As shown in FIG. 11, each of the rotary solenoids 41BK, 41C, 41M and 41Y is connected to the control drive section through the actuator drive section 26.

For full color copying in the above described fourth embodiment, the rotary solenoids 41BK, 41C, 41M and 41Y are not operated and the developing devices 100BK, 100C, 100M and 100y are held in the respective operating positions by the springs 44BK, 44C, 44M and 44Y, respectively. In the operating positions, the developing sleeves of the developing devices are kept in contact with the corresponding photoconductive drums 2BK, 2C, 2M and 2Y, so that image forming operations are carried out by driving the first and second drum drive motors 50 and 56 and the first and second developing device drive motors 74 and 78 as in the case of the above described first embodiment.

For monochromatic printing, typically black printing, the rotary solenoids 41C, 41M and 41Y are driven by a signal transmitted from the drive control section 300 to cause the cams 42C, 42M and 42Y to press the respective projections 43C, 43M and 43Y. Thus, the developing devices 100C, 100M and 100Y are rotated around the respective pivots 45C, 45M and 45Y to move to their respective separated positions wherein the developing sleeves of the developing devices are away from the respective photoconductive drums 2C, 2M and 2Y.

With such an arrangement, in the black copying operation, the second drum drive motor 56 and the second developing device drive motor 78 are stopped and the image forming sections 10C, 10M and 10Y are kept in nonoperating condition. Thus, unnecessary wear and tears of the drum surfaces due to the contact with the cleaning devices 6C, 6M and 6Y and contact with the developing devices can be prevented. Further, any wear of the developing sleeves of the developing devices due to contact with respective toners and consequent degradation of the latter can be minimized. Particularly, in the fourth embodiment, the developing devices not used for copying operation can be separated from the corresponding photoconductive drums, so that undesired deformation of the nonoperating developing devices and photoconductive drums due to unnecessary contact can be prevented.

The developing device drive motors may or may not be driven while the respective developing devices are kept away from the corresponding photoconductive drums. Additionally, any developing device can moved away from the corresponding drum, so that monochromatic image formation in other than black can be realized.

Figure 13:
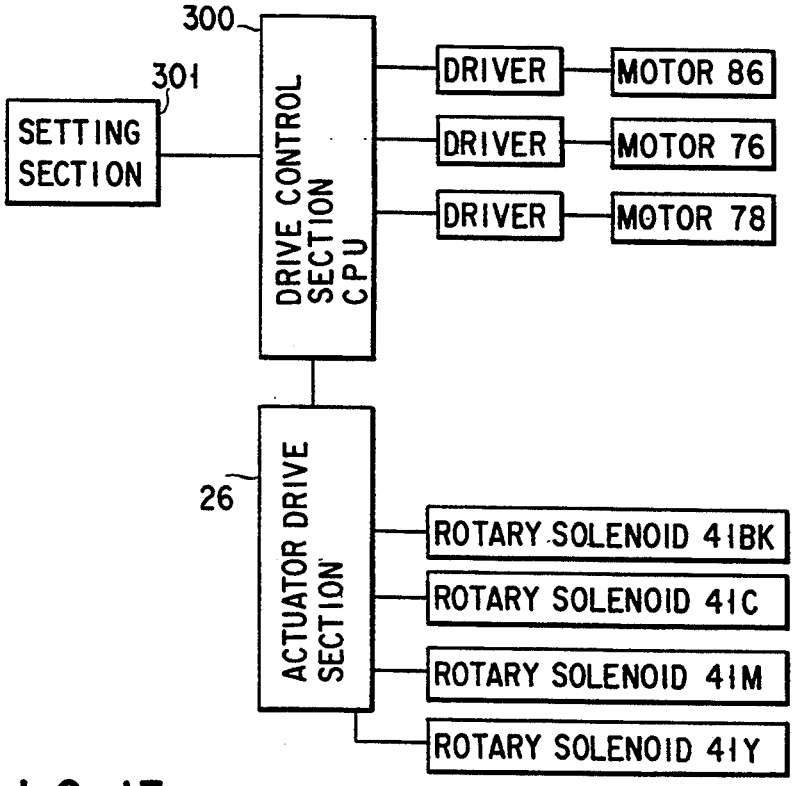
FIG. 13 is a block diagram of the drive mechanism of the fifth embodiment.
Figure 12:
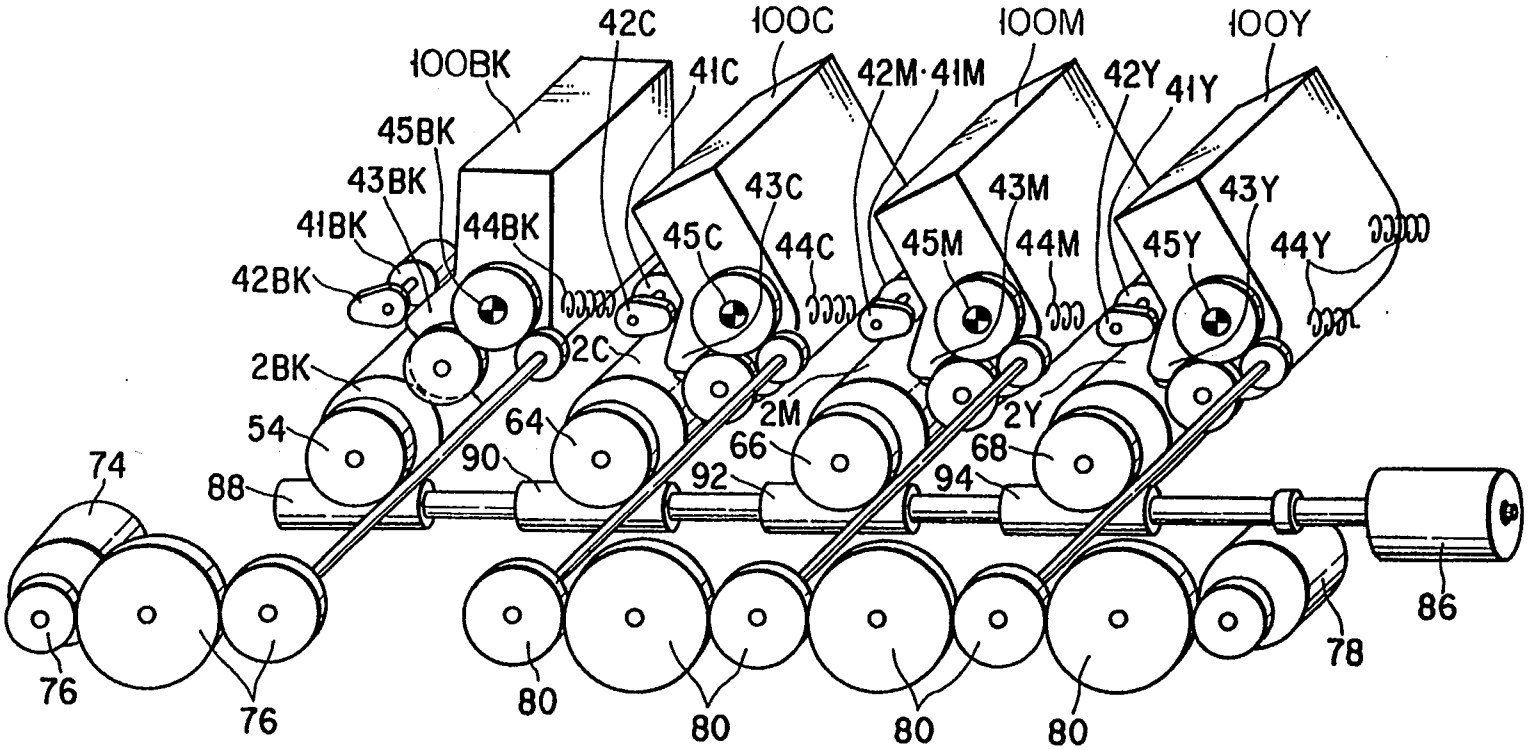
FIG. 12 is a schematic perspective view showing a drive mechanism of a color copying machine according to a fifth embodiment of the present invention.

FIG. 12 and 13 show a drive mechanism of a color copying machine according to a fifth embodiment of the present invention. This embodiment has a basic configuration which is same as that of the above described fourth embodiment. Namely, the developing devices 100BK, 100C, 100M and 100Y are arranged to be rotatable and provided with respective rotary solenoids for rotating the developing devices. This embodiment differs from the fourth embodiment in that a single drive motor is commonly used to drive the photoconductive drums for both black printing and color printing, and the separating mechanisms 40 for separating the photoconductive drums 2C, 2M and 2Y from the conveyer belt 12 are omitted. In this embodiment, the same components as in the fourth embodiment are indicated by the same reference numerals as in the fourth embodiment, and the detailed description thereof will be omitted.

Unlike the fourth embodiment, the drum drive motor 86 of this fifth embodiment is driven to operate all the four photoconductive drums 2BK, 2C, 2M and 2Y for both black printing and color printing. Other operations in the fifth embodiment are same as those in the fourth embodiment and the same advantages can be obtained.

Figure 14:
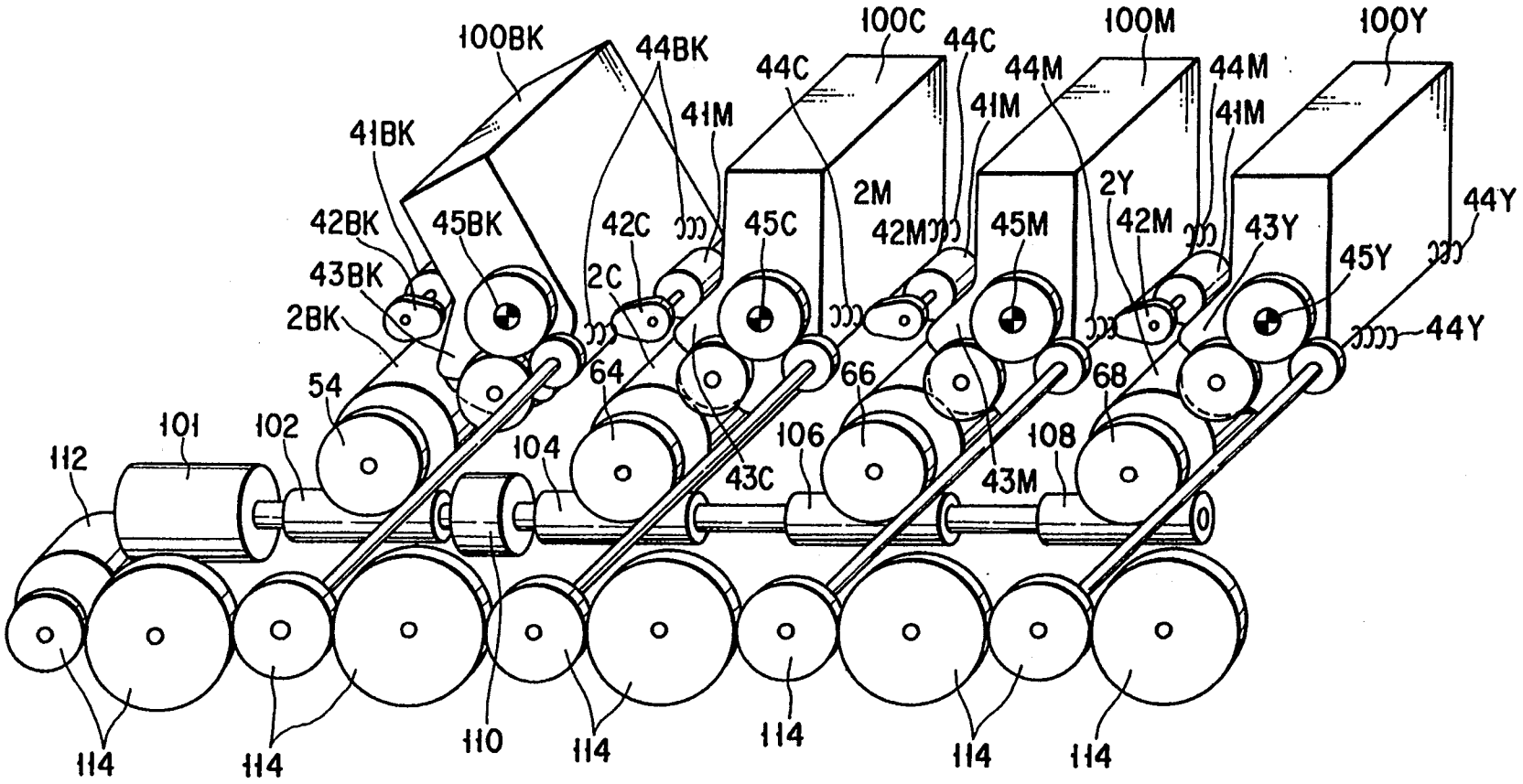
FIG. 14 is a schematic perspective view showing a drive mechanism of a color copying machine according to a sixth embodiment of the present invention.
Figure 15:
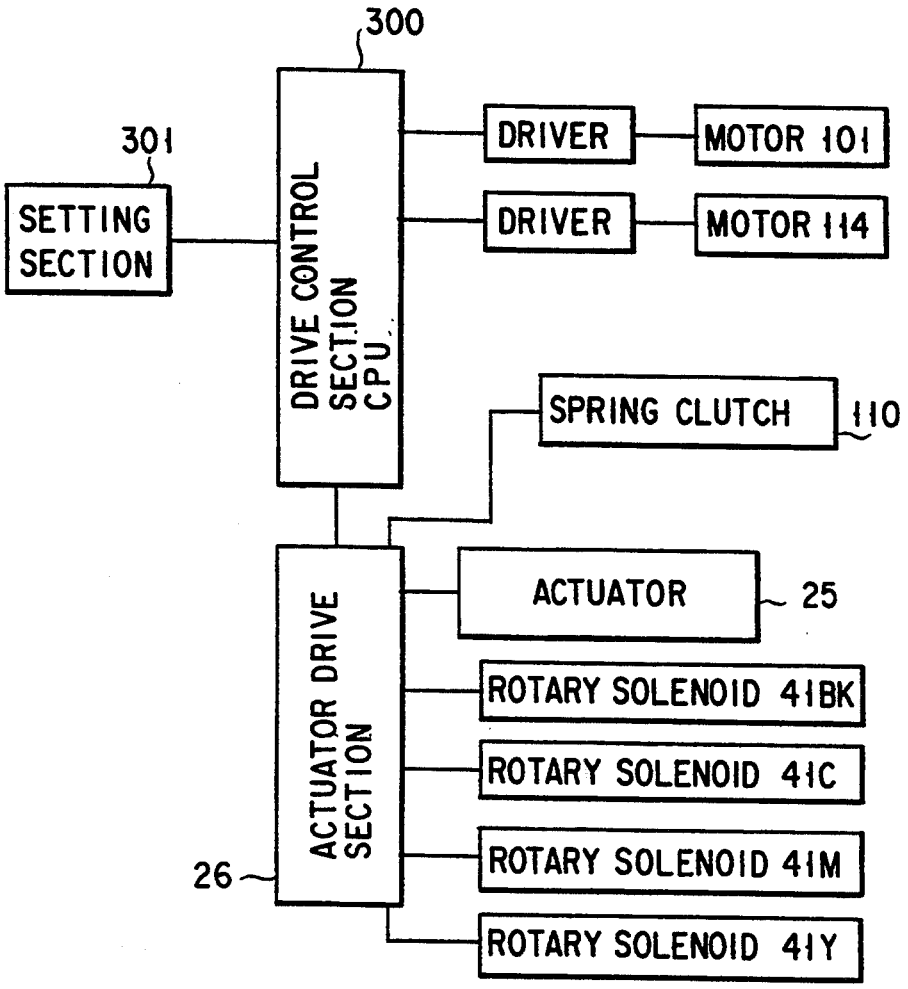
FIG. 15 is a block diagram of the drive mechanism of the sixth embodiment.

FIGS. 14 and 15 show a drive mechanism of a color copying machine according to a sixth embodiment of the present invention. This embodiment comprises a single drum drive motor 101 for driving all the four photoconductive drums 2BK, 2C, 2M and 2Y. A drive shaft is connected to the rotary shaft of the drive motor 101 and four worm gears 102, 104, 106 and 108 are rigidly fitted on the drive shaft 101 for the respective photoconductive drums. Helical gears 54, 64, 66 and 68 are fitted on the rotary shafts of the photoconductive drums and in engagement with the worm gears 102, 104, 106 and 108, respectively. A spring clutch 110 is arranged between the worm gears 102 and 104 and connected to the actuator drive section 26.

A five-phase stepping motor is used as the drive motor 101. If a DC motor is used as the drive motor 101, the following problems occur. Specifically, by switching ON and OFF the spring clutch 110, the drums 2C, 2M and 2Y are driven and stopped. However, depending on the operating condition of the drums 2C, 2M and 2Y, load applied on the motor 101 changes, so that a feedback constant suitable for PLL control of the motor can not be determined to thereby influencing the formed image. Accordingly, a stepping motor with an opened loop control is used as the drive motor 101.

The drive system for the developing devices comprises a single developing device drive motor 112 which is used for both black copying operation and color copying operation. The drive force of the drive motor 112 is transmitted to the developing devices 100BK, 100C, 100M and 100Y by way of respective gear trains 114.

In the sixth embodiment, the drum drive motor 101 drives the photoconductive drums through the respective worm gears 102, 104, 106 and 108. The drive force of the drive motor 101 is selectively transmitted to and interrupted from the drums 100C, 100M and 100Y when the spring clutch is switched ON and OFF by a signal from the actuator drive section 26. More specifically, in the black copying operation, the spring clutch 110 is turned off so that the drive force of the motor 101 is not transmitted to the photoconductive drums 2C, 2M and 2Y and they are not rotated. On the other hand, the drive force of the developing device drive motor 112 is always transmitted to the developing devices for four different colors. Another operations of this embodiment are same as those of the fourth embodiment.

In the sixth embodiment, the same components as in the fourth embodiment are indicated by the same reference numerals and their detailed description will be omitted.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus comprising:

first drive means for rotating a plurality of rotatable image carriers, the first drive means having a first image carrier drive motor for driving at least one of said image carriers, and a second image carrier drive motor for driving the image carriers other than said at least one of said image carriers;

means for forming electrostatic latent images on the image carriers;

developing means having a plurality of developing rollers arranged in contact with the image carriers, respectively, for developing the electrostatic latent images by rotations of the image carriers and the developing rollers;

second drive means for rotating the developing rollers;

first transmitting means for, when the developing means performs a development with respect to one or some of the image carriers, transmitting the drive force of the first drive means to only the image carrier or image carriers used for the development;

second transmitting means for, when the developing means performs a development with respect to one or some of the image carriers, transmitting the drive force of the second drive means to only the developing roller or rollers contacting said one or some of the image carriers; and transfer means for transferring the developed image or developed images from the image carrier or image carriers, on which the electrostatic latent images are developed, to a transfer material.

2. An apparatus according to claim 1, wherein said drive means includes a first developing device drive motor for driving at least one of said developing rollers and a second developing device drive motor for driving the remaining developing rollers.

3. A color image forming apparatus, comprising:

first image forming means for forming an image in black on a first photoconductive drum;

second image forming means for forming an image in a first color different from black on a second photoconductive drum;

third image forming means for forming an image in a second color different from black on a third photoconductive drum;

first rotating means for rotating the first photoconductive drum;

second rotating means for rotating the second and third photoconductive drums;

transfer means for transferring images, which are formed by the first, second and third image forming means, to a transfer material;

first control means for actuating the first and second rotating means to rotate the first, second and third photoconductive drums, when a color image in black, first and second colors is formed on the transfer material; and second control means for actuating the first rotating means to rotate the first photoconductive drum and stopping the second rotating means to stop the rotation of the second and third photoconductive drums, when only an image in black is formed on the transfer material.

4. An apparatus according to claim 3, wherein said first image forming means has a first developing device for forming a toner image on the first photoconductive drum, said second image forming means has a second developing device for forming a toner image on the second photoconductive drum, said third image forming means has a third developing device for forming a toner image on the first photoconductive drum, wherein the apparatus further comprises first developing device drive means for driving the first developing device, and second developing device drive means for driving the second and third developing devices, wherein said first control means has means for actuating the first and second developing device drive means to drive the first, second and third developing devices, when a color image with black, first and second colors is formed on the transfer material, and wherein said second control means has means for actuating the first developing device drive means to drive the first developing device and stopping the second developing device drive means to stop the second and third developing devices, when only an image in black is formed on the transfer material.

5. An apparatus according to claim 3, wherein said first image forming means has a first developing device for forming a toner image on the first photoconductive drum, said second image forming means has a second developing device for forming a toner image on the second photoconductive drum, said third image forming means has a third developing device for forming a toner image on the first photoconductive drum, each of said first, second, third developing devices being movable between a developing position where the device contacts the corresponding photoconductive drum and a separate position where the developing device is separated from the corresponding photoconductive drum, and wherein the apparatus further comprises means for moving the second and third developing devices to the separate positions, when only an image in black is formed on the transfer material.

6. A color image forming apparatus comprising:

first image forming means for forming an image in black on a first photoconductive drum;

second image forming means for forming an image in a first color different from black on a second photoconductive drum;

a third image forming means for forming an image in a second color different from black on a third photoconductive drum;

first rotating means for rotating the first photoconductive drum;

second rotating means for rotating the second and third photoconductive drums;

a transfer belt for transporting a transfer material through the first, second and third image forming means;

first transfer means for transferring an image in black, which is formed by the first image forming means, to the transfer material, the first transfer means having a first transfer roller for rolling contact with the first photoconductive drum with the transfer belt interposed between the first transfer roller and the first photoconductive drum;

second transfer means for transferring an image in the first color, which is formed by the second image forming means, to the transfer material, the second transfer means having a second transfer roller for rolling contact with the second photoconductive drum with the transfer belt interposed between the second transfer roller and the second photoconductive drum;

third transfer means for transferring an image in the second color, which is formed by the third image forming means, to the transfer material, the third transfer means having a third transfer roller for rolling contact with the third photoconductive drum with the transfer belt interposed between the third transfer roller and the third photoconductive drum;

first control means for actuating the first and second rotating means to rotate the first, second and third photoconductive drums, when a color image in black, first and second colors is formed on the transfer material;

second control means for actuating the first rotating means to rotate the first photoconductive drum and stopping the second rotating means to stop the rotation of the second and third photoconductive drums, when only an image in black is formed on the transfer material;

first moving means for moving the second photoconductive drum and the second transfer roller relative to each other so that the second transfer roller is away from the second photoconductive drum, when only an image in black is formed on the transfer material; and second moving means for moving the third photoconductive drum and the third transfer roller relative to each other so that the third transfer roller is away from the third photoconductive drum, when only an image in black is formed on the transfer material.

7. An apparatus according to claim 6, wherein said first image forming means has a first developing device for forming a toner image on the first photoconductive drum, said second image forming means has a second developing device for forming a toner image on the second photoconductive drum, said third image forming means has a third developing device for forming a toner image on the first photoconductive drum, wherein the apparatus further comprises first developing device drive means for driving the first developing device, and second developing device drive means for driving the second and third developing devices, wherein said first control means has means for actuating the first and second developing device drive means to drive the first, second and third developing devices, when a color image with black, first and second colors is formed on the transfer material, and wherein said second control means has means for actuating the first developing device drive means to drive the first developing device and stopping the second developing device drive means to stop the second and third developing devices, when only an image in black is formed on the transfer material.

8. An apparatus according to claim 6, wherein said first image forming means has a first developing device for forming a toner image on the first photoconductive drum, said second image forming means has a second developing device for forming a toner image on the second photoconductive drum, said third image forming means has a third developing device for forming a toner image on the first photoconductive drum, each of said first, second, third developing devices being movable between a developing position where the device contacts with the corresponding photoconductive drum and a separate position where the developing device is separated from the corresponding photoconductive drum; and wherein the apparatus further comprises means for moving the second and third developing devices to the separate positions, when only an image in black is formed on the transfer material.

9. An image forming apparatus, comprising:

first drive means for rotating a plurality of rotatable image carriers, the first drive means having a first image carrier drive motor for driving at least one of said image carriers, and a second image carrier drive motor for driving the remaining image carriers;

means for forming electrostatic latent images on the image carriers;

developing means having a plurality of developing rollers arranged to face the image carriers, respectively, for developing the electrostatic latent images by rotations of the image carriers and the developing rollers;

second drive means for rotating the developing rollers;

first transmitting means for, when the developing means performs a development with respect to one or some of the image carriers, transmitting the drive force of the first drive means to only the image carrier or image carriers used for the development;

second transmitting means for, when the developing means performs a development with respect to one or some of the image carriers, transmitting the drive force of the second drive means to only the developing roller or rollers contacting said one or some of the image carriers; and transfer means for transferring the developed image or developed images from the image carrier or image carriers, on which the electrostatic latent images are developed, to a transfer material.

* * * * *